US011296459B2

(12) United States Patent
Akagi

(10) Patent No.: US 11,296,459 B2
(45) Date of Patent: Apr. 5, 2022

(54) LEVER-TYPE CONNECTOR

(71) Applicant: Yazaki Corporation, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/924,871

(22) Filed: Jul. 9, 2020

(65) Prior Publication Data

US 2021/0013674 A1 Jan. 14, 2021

(30) Foreign Application Priority Data

Jul. 12, 2019 (JP) ..... JP2019-129751

(51) Int. Cl.
*H01R 13/629* (2006.01)

(52) U.S. Cl.
CPC ..... *H01R 13/62938* (2013.01)

(58) Field of Classification Search
CPC ..... H01R 13/62938; H01R 13/62955; H01R 13/62933; H01R 13/62905; H01R 13/62922; H01R 13/62966; H01R 13/62977
See application file for complete search history.

(56) References Cited

U.S. PATENT DOCUMENTS 5,876,225 A 3/1999 Katsuma et al.
6,602,082 B2 * 8/2003 Nishide ..... H01R 13/62938 439/157
2011/0130026 A1 6/2011 Makino et al.
2015/0325950 A1 * 11/2015 Kamiya ..... H01R 13/62933 439/157

FOREIGN PATENT DOCUMENTS

JP 09-223539 A 8/1997
JP 2003-264035 A 9/2003

* cited by examiner

*Primary Examiner* — Vanessa Girardi
(74) *Attorney, Agent, or Firm* — Sughrue Mion, PLLC

(57) ABSTRACT

A lever-type connector includes a mating housing having a cam boss and a release rib portion, a housing that has a support shaft and a temporarily locked portion and that is fitted into and removed from the mating housing, and a lever having a temporary locking arm portion where a temporary locking portion is temporarily locked to the temporarily locked portion and is unlocked from the temporarily locked portion by the release rib portion, the lever having a cam groove including a boss pick-up portion and a boss holding portion that engage with the cam boss, and the lever being rotated from a temporary locking position to a fitting completion position via the support shaft to cause the cam groove to engage with the cam boss, thus moving the mating housing toward the housing and fitting the mating housing and the housing to each other.

3 Claims, 7 Drawing Sheets

LEVER-TYPE CONNECTOR

CROSS-REFERENCE TO RELATED APPLICATIONS

The present application is based on, and claims priority from Japanese Patent Application No. 2019-129751, filed on Jul. 12, 2019, the entire contents of which are incorporated herein by reference.

TECHNICAL FIELD

The present application relates to a lever-type connector in which connectors can be fitted to each other with low insertion force due to rotation of a lever.

BACKGROUND

JP 9-223539 A discloses this type of lever-type connector. This lever-type connector includes a housing having a hood portion that is fitted into and removed from a mating housing. In addition, the lever-type connector includes a lever. By rotating the lever from an initial orientation to a fitting completion position, a cam groove is engaged with a cam pin and thus the housing and the mating housing are fitted to each other. In this lever, the mounting portions are each rotatably supported by support shafts on both sides of the housing. Further, the lever has the cam groove that engages with the cam pin arranged in the mating housing. Each of the mounting portions of the lever includes a locking projection for restricting the rotation of the lever at a position shifted from an introduction trajectory of the cam pin into the cam groove.

However, since the lever-type connector has a structure of reducing the amount of displacement of the lever when its temporary set lock state is released, no holding force is applied between the housing and the mating housing in a temporary set state. Due to the lack of this holding force, the housing may be easily removed from the mating housing before the lever is rotated.

SUMMARY

The present application has been achieved in order to solve the above problems, and an object of the application is to provide a lever-type connector that can reduce insertion force at the time of temporarily setting a mating housing and a housing and that can increase holding force.

A lever-type connector according to a first aspect of the present application includes a mating housing having a cam boss, a housing that is fitted into and removed from the mating housing, and a lever that is rotatably supported by the housing via a support shaft, has a cam groove engaging with the cam boss, and is rotated from a temporary locking position to cause the cam groove to engage with the cam boss, thus moving the mating housing toward the housing and fitting the mating housing and the housing to each other. The lever includes a temporary locking arm portion that has a temporary locking portion and is elastically deformable, the housing includes a temporarily locked portion that is temporarily locked to and unlocked from the temporary locking portion of the temporary locking arm portion, and the mating housing includes a release rib portion that releases a temporary locking state of the temporary locking portion of the temporary locking arm portion and the temporarily locked portion of the housing. The cam groove of the lever includes a boss pick-up portion and a boss holding portion that engage with the cam boss.

A lever-type connector according to a second aspect of the present application relates to the lever-type connector according to the first aspect. The cam groove of the lever includes a boss receiving portion that receives the cam boss when a temporary locking state of the temporary locking portion of the temporary locking arm portion and the temporarily locked portion of the housing is released in a state where the mating housing and the housing are temporarily set.

According to the above configuration, it is possible to provide a lever-type connector that can reduce insertion force at the time of temporarily setting the mating housing and the housing, and that can increase holding force.

DETAILED DESCRIPTION

Figure 1:
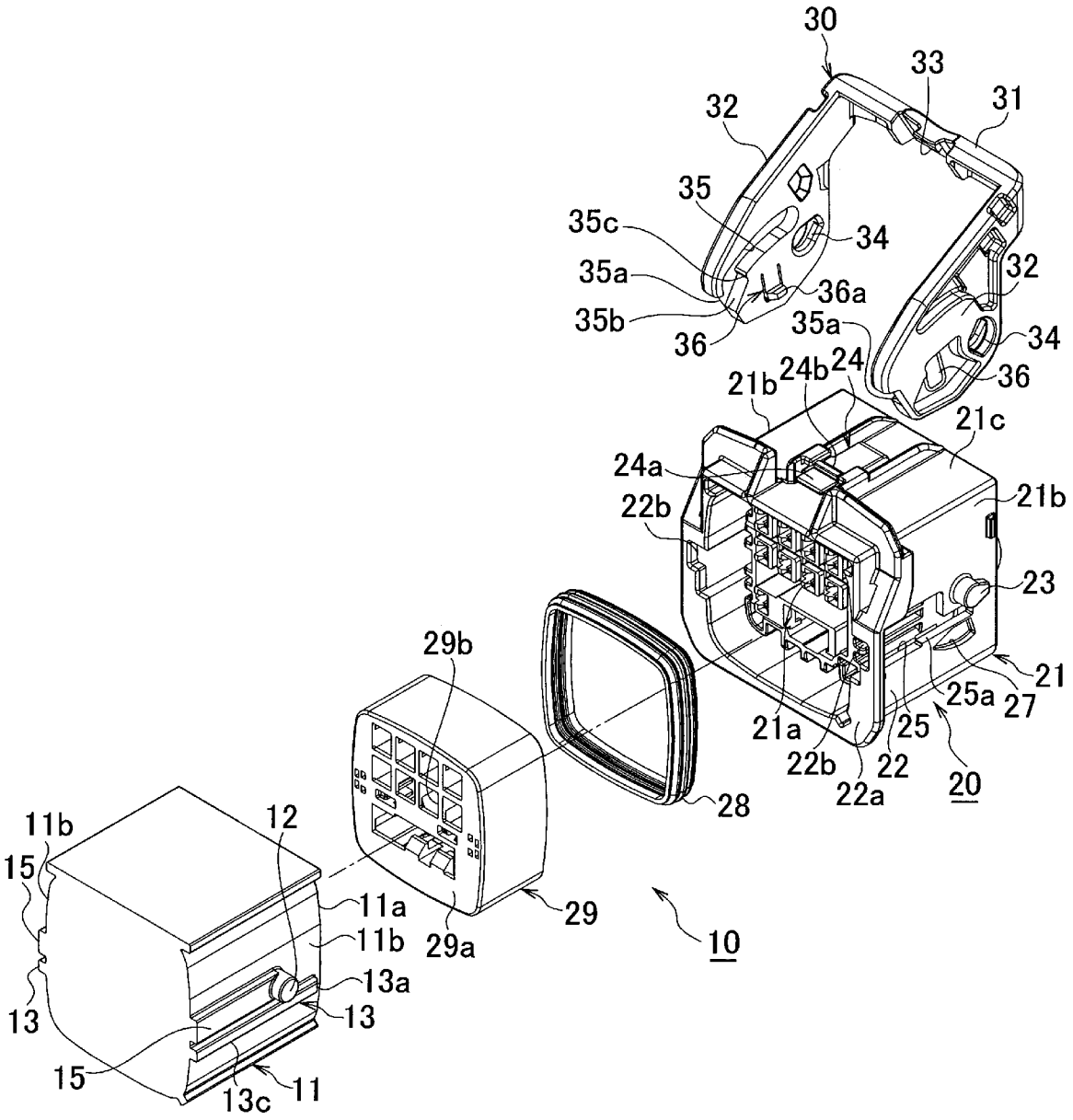
FIG. 1 is an exploded perspective view illustrating an example of a lever-type connector according to the present embodiment.

Hereinafter, a lever-type connector according to the present embodiment will be described in detail with reference to the drawings. Note that the dimensional ratios in the drawings are exaggerated for convenience of explanation, and may differ from the actual ratios.

As illustrated in FIG. 1, a lever-type connector 10 includes a male housing (mating housing) 11 that is made of synthetic resin and has a cam boss 12, a female housing (housing) 20 that is made of synthetic resin and is fitted into and removed from the male housing 11, and a lever 30 made of synthetic resin. The lever 30 is rotatably supported by a support shaft 23 arranged in the female housing 20, and has a cam groove 35 that engages with the cam boss 12 of the male housing 11. By rotating an operating portion 31 of the lever 30, the cam groove 35 is engaged with the cam boss 12 and thus the male housing 11 is made to move toward the female housing 20, so that the male housing 11 and the female housing 20 are fitted to each other. In FIG. 1, the direction in which the male housing 11 and the female housing 20 are fitted to each other is referred to as "fitting direction", the direction orthogonal to the fitting direction, in which the cam bosses 12 formed on both side surfaces 11*b*, 11*b* of the male housing 11 are connected, is referred to as "width direction", and the vertical direction in the figure orthogonal to the fitting direction and the width direction, in which an upper surface 21*c* and a bottom surface of the female housing 20 are connected, is referred to as "height direction". Note that the directions such as "longitudinal" and "vertical" are defined for convenience of explanation, and do not limit the actual mounting orientations of the respective elements.

Figure 2:
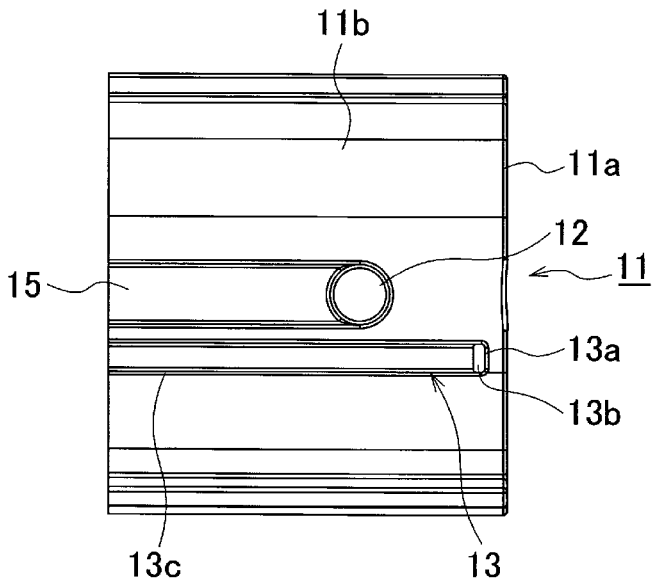
FIG. 2 is a side view of a male housing of the lever-type connector.

As illustrated in FIGS. 1 and 2, the male housing 11 has, on the front side (one fitting-direction side), a hood portion 11*a* that is inserted into a hood portion 22 of the female housing 20. The cylindrical cam boss 12 is integrally formed in a projecting manner at a center in the height direction of each of the side surfaces 11*b*, 11*b* of the male housing 11 in the width direction. A release rib portion 13 extending in the longitudinal direction (fitting direction) is integrally formed in a projecting manner under (on one height-direction side of) the cam boss 12 on each of the side surfaces 11*b*, 11*b* of the male housing 11. A distal end 13*a* of the release rib portion 13 on one fitting-direction side functions as a release portion that releases a temporary locking state of a cutaway portion (temporarily locked portion) 25 of the female housing 20 and a temporary locking projection (temporary locking portion) 36*a* of a temporary locking arm portion 36 of the lever 30, which will be described later. As illustrated in FIG. 2, a slope 13*b* is formed on the back side (other fitting-direction side) of the distal end 13*a* of the release rib portion 13. In the hood portion 11*a* of the male housing 11, a tab portion of a male terminal (terminal), which is not illustrated, is exposed.

As illustrated in FIG. 1, the female housing 20 includes a block-like housing main body 21 having a plurality of terminal accommodating chambers 21*a*, and the hood portion 22 that is integrally formed in a projecting manner on the front side (other fitting-direction side) of the housing main body 21 and into which the hood portion 11*a* of the male housing 11 is fitted. The support shaft 23 is integrally formed in a projecting manner at a center in the height direction of each of side surfaces 21*b*, 21*b* of the housing main body 21 in the width direction. An elastically deformable locking arm portion 24 is integrally formed in a projecting manner on the front side (other fitting-direction side) at a center in the width direction of the upper surface 21*c* of the housing main body 21 in the height direction. A receiving portion 24*b* is integrally formed in a projecting manner at a free end (distal end) 24*a* of the locking arm portion 24.

Figure 3:
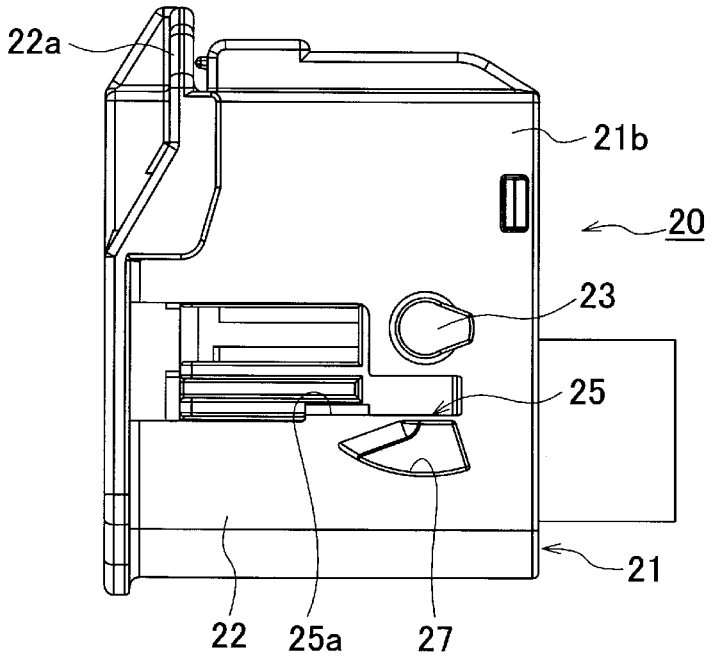
FIG. 3 is a side view of a female housing of the lever-type connector.

As illustrated in FIGS. 1 and 3, the substantially rectangular cutaway portion (temporarily locked portion) 25 is formed on the front side (other fitting-direction side) at a center in the height direction of each of side portions of the hood portion 22 of the female housing 20 in the width direction. That is, the temporary locking projection 36*a* of the temporary locking arm portion 36 of the lever 30 to be described later is temporarily locked to or unlocked from a lower edge 25*a* of each cutaway portion 25 in the height direction. When the temporary locking projection 36*a* of the temporary locking arm portion 36 is temporarily locked to the lower edge 25*a* of the cutaway portion 25, the lever 30 is held at a temporary lock position.

As illustrated in FIG. 1, a rectangular cylindrical front holder 29 that is made of synthetic resin and has a front wall portion 29*a* is fitted to the periphery of a plurality of the terminal accommodating chambers 21*a* of the housing main body 21 in the hood portion 22 of the female housing 20. A rectangular annular packing 28 made of rubber is interposed between the hood portion 22 of the female housing 20 and the periphery of the terminal accommodating chambers 21*a* of the housing main body 21. The front wall portion 29*a* of the front holder 29 includes a plurality of rectangular openings 29*b* communicating with the plurality of terminal accommodating chambers 21*a* of the housing main body 21. A female terminal (not illustrated) is accommodated in the terminal accommodating chamber 21*a* of the housing main body 21. The female terminal accommodated in the terminal accommodating chamber 21*a* of the housing main body 21 is held by a lance (not illustrated) arranged in the terminal accommodating chamber 21*a*.

Figure 4A:
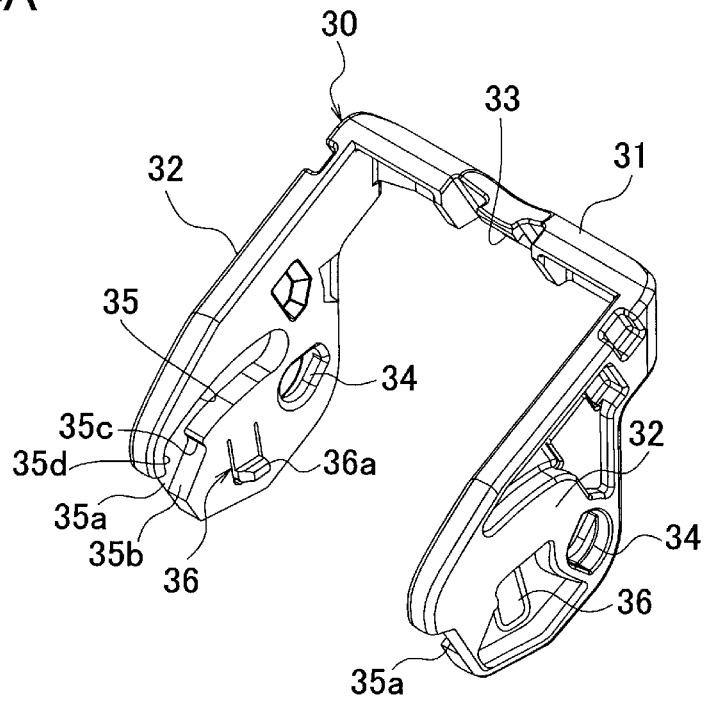
FIG. 4A is a perspective view of a lever of the lever-type connector.

As illustrated in FIGS. 1 and 4A, the lever 30 includes the operating portion 31 and a pair of arm portions 32, 32 extending from both sides of the operating portion 31 in the width direction.

As illustrated in FIGS. 1 and 4A, a locking projection 33 is formed on the lower side (one height-direction side) at a center in the width direction of the operating portion 31 of the lever 30. When the lever 30 is rotated to a rotation completion position, the locking projection 33 is locked to the receiving portion 24*b* of the locking arm portion 24 in the female housing 20. This locking brings about a rotation restricting state where the rotation of the lever 30 is restricted. The lock state of the locking projection 33 of the lever 30 and the receiving portion 24*b* of the locking arm portion 24 in the female housing 20 is released by pressing the side of the free end 24*a* of the locking arm portion 24 downward (one height-direction side) so as to detach the receiving portion 24*b* of the locking arm portion 24 from the locking projection 33.

As illustrated in FIGS. 1 and 4A, a bearing hole 34 that is rotatably supported by the support shaft 23 is formed on the back side (one fitting-direction side) of each arm portion 32 of the lever 30. The arcuate recessed cam groove 35 is formed in each of the inner sides of the arm portions 32 (sides at which arm portions 32 face to each other in width direction). The temporary locking arm portion 36 that is elastically deformable and has the temporary locking projection (temporary locking portion) 36*a* at its distal end is integrally formed on each of the lower sides (one height-direction side) of the arm portions 32. The temporary locking state of the temporary locking projection 36*a* of the temporary locking arm portion 36 in the lever 30 and the lower edge 25*a* of the cutaway portion 25 in the female housing 20 is released by the distal end 13*a* of the release rib portion 13 in the male housing 11.

Figure 4B:
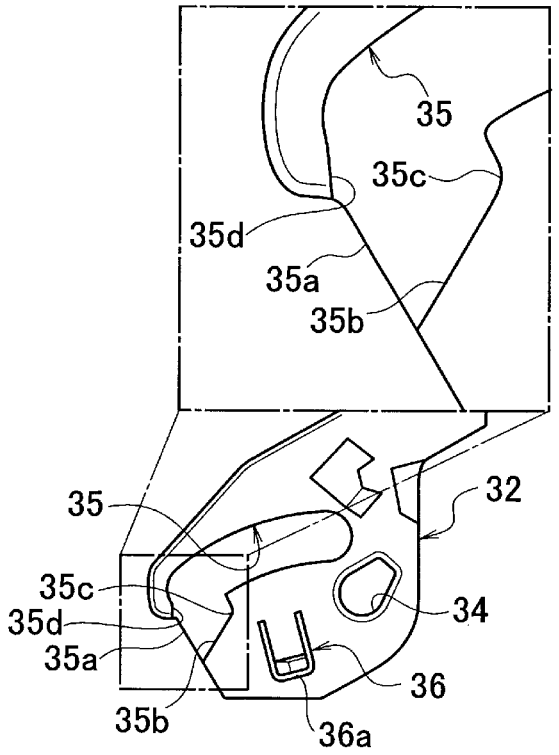
FIG. 4B is an enlarged side view of a main part of the lever.

As illustrated in FIGS. 4A, 4B, 7, and 11, the cam groove 35 of the arm portion 32 of the lever 30 includes a boss pick-up portion 35*b* having a surface inclined obliquely upward from a side of an insertion port 35*a* of the cam boss 12 (direction from insertion port 35*a* to inner side of cam groove 35, that is, direction toward one fitting-direction side and the other height-direction side in FIG. 4B). A boss holding portion 35*d* that has an L-shaped side surface and holds the cam boss 12 is formed on the upper side (other height-direction side in FIG. 4B) that faces the boss pick-up portion 35*b* of the cam groove 35.

Figure 9:
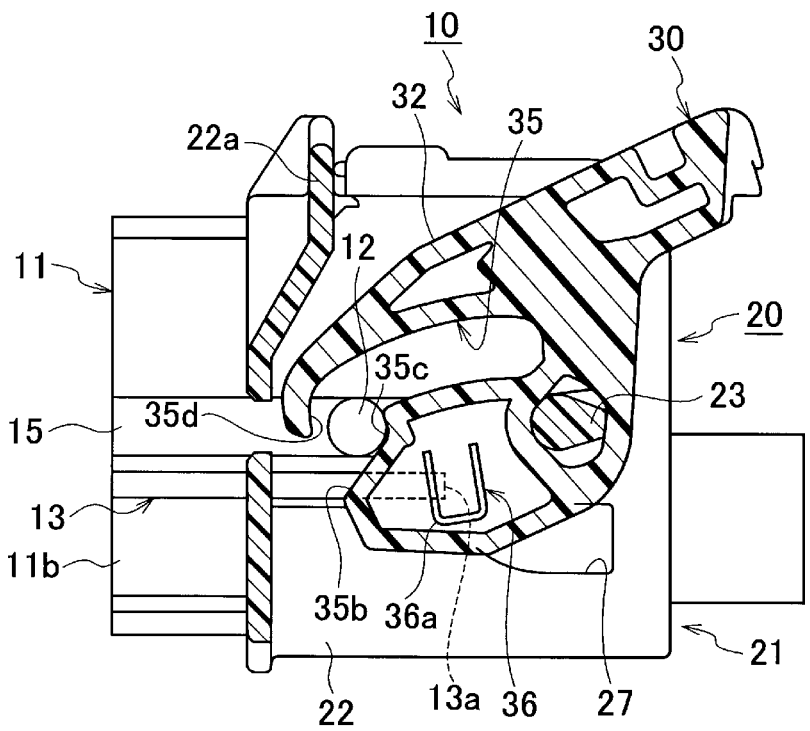
FIG. 9 is a sectional view taken along the line A-A in FIG. 6, illustrating the state after the male housing and the female housing are temporarily set.
Figure 10:
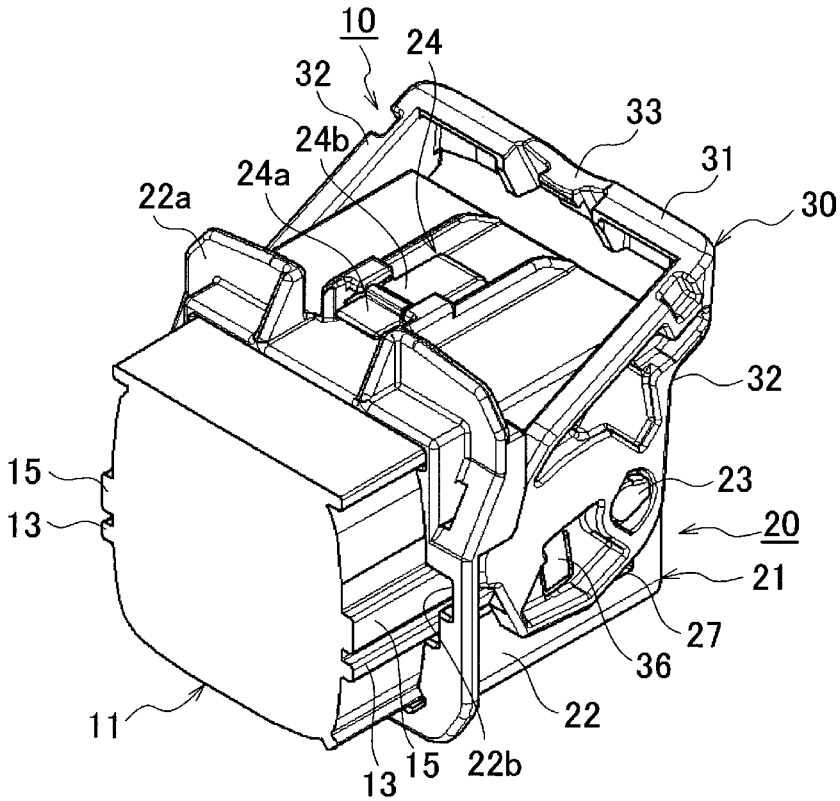
FIG. 10 is a perspective view illustrating a state where the temporary setting of the male housing and the female housing is maintained.

As illustrated in FIGS. 4A, 4B, and 9, the cam groove 35 of the lever 30 includes a boss receiving portion 35*c* that receives the cam boss 12 on the side of the boss pick-up portion 35*b*. The boss receiving portion 35*c* is formed as a step on the inner side of the boss pick-up portion 35*b* (in direction from insertion port 35*a* to inner side of cam groove 35). The boss receiving portion 35*c* functions when the temporary locking state of the temporary locking projection 36*a* of the temporary locking arm portion 36 and the cutaway portion 25 of the female housing 20 is released in a state where the male housing 11 and the female housing 20 are temporarily set.

Figure 5:
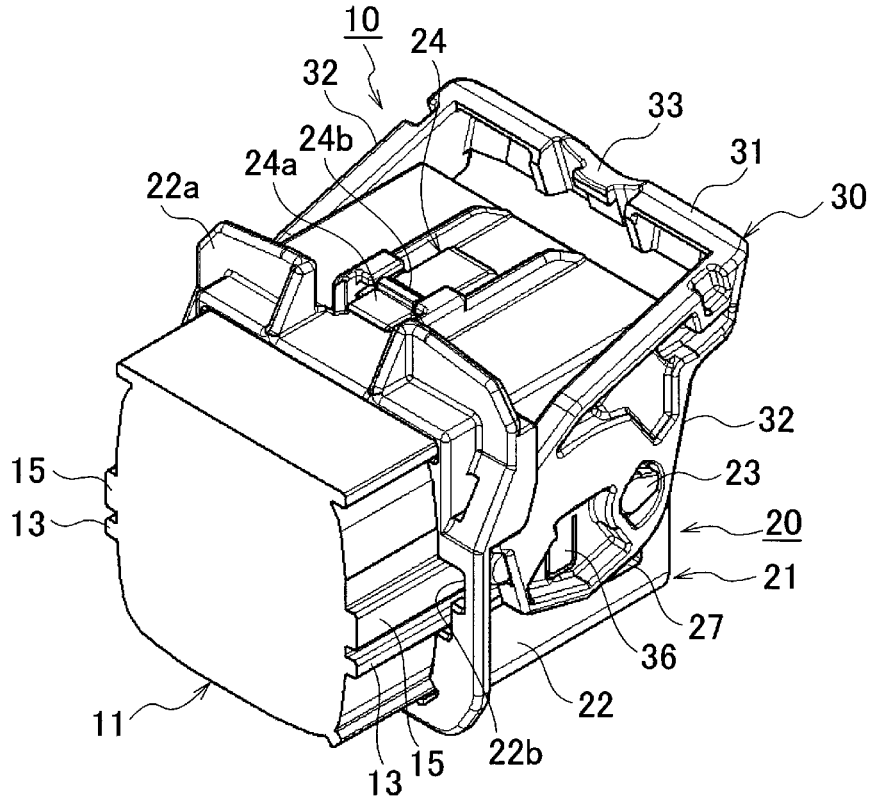
FIG. 5 is a perspective view illustrating a state before the male housing and the female housing are temporarily set.
Figure 6:
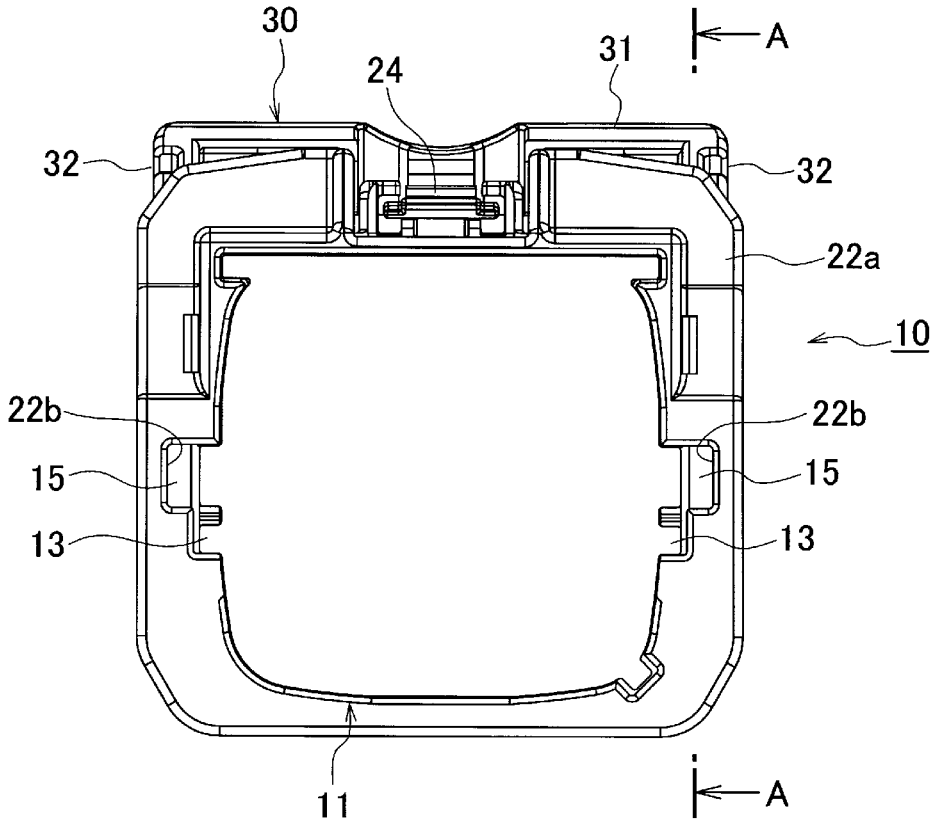
FIG. 6 is a front view of the lever-type connector before the temporary setting.

As illustrated in FIGS. 1 and 6, a protrusion 15 parallel to the release rib portion 13 in the fitting direction is integrally formed in a projecting manner on the back side (on other fitting-direction side of) of the cam boss 12 on each of the side surfaces 11*b*, 11*b* of the male housing 11. As illustrated in FIG. 5, when the male housing 11 is inserted into the hood portion 22 of the female housing 20, the protrusion 15 of the male housing 11 is accommodated and guided in a recess 22*b* on each of both sides of a flange portion 22*a* of the hood portion 22 in the female housing 20. When the lever 30 is rotated from a temporary locking position to a rotation completion position, the locking projection 33 of the lever 30 is locked to the receiving portion 24*b* of the locking arm portion 24 in the female housing 20 and maintained in a rotation restricting state. At this time, the temporary locking projection 36*a* of the temporary locking arm portion 36 formed on the arm portion 32 of the lever 30 is moved to a hole 27 formed from the lower edge 25*a* of the cutaway portion 25 made on each of both sides of the hood portion 22 in the female housing 20 downward (toward one height-direction side) of the cutaway portion 25, and then is accommodated in the hole 27.

Figure 7:
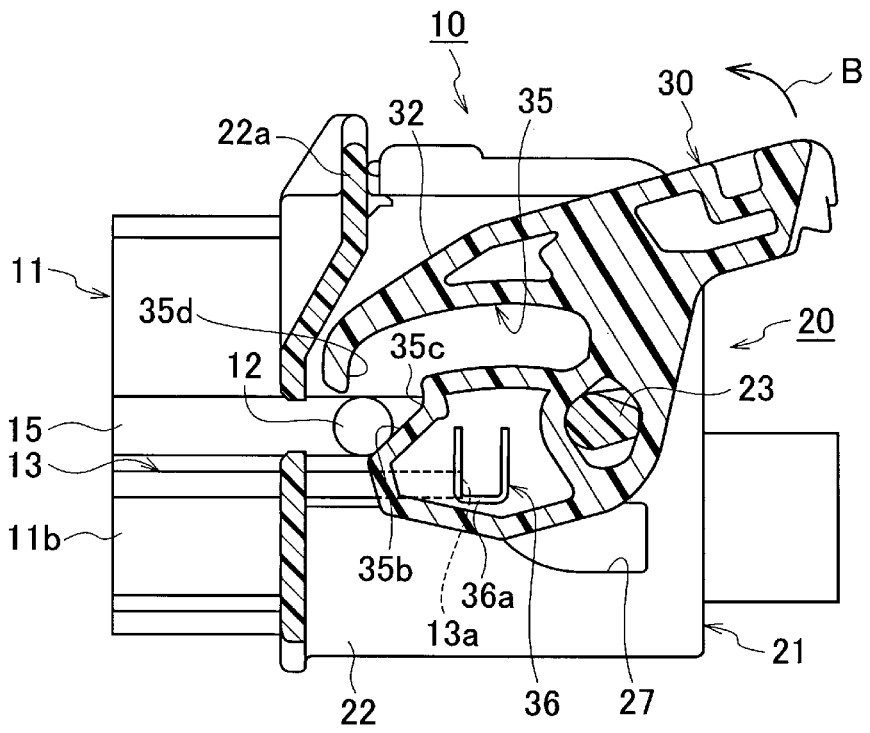
FIG. 7 is a sectional view taken along a line A-A in FIG. 6.
Figure 8:
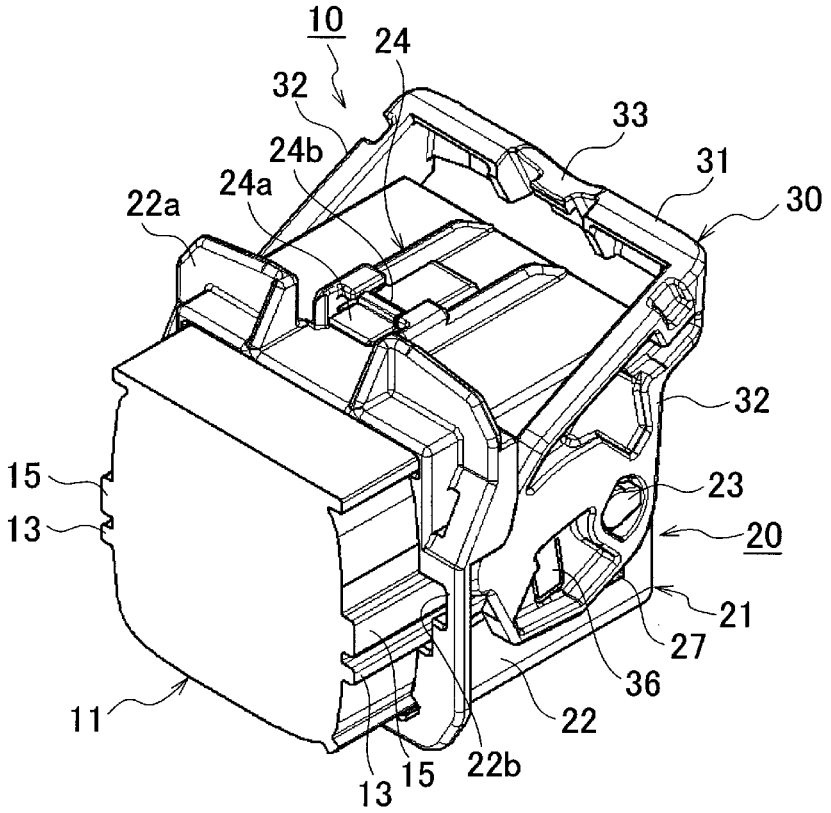
FIG. 8 is a perspective view illustrating a state after the male housing and the female housing are temporarily set.

As described above, according to the lever-type connector 10 of the embodiment, as illustrated in FIGS. 5 to 7, when the hood portion 11*a* of the male housing 11 is pushed and inserted into the hood portion 22 of the female housing 20, the cam boss 12 of the male housing 11 slides on the boss pick-up portion 35*b* of the cam groove 35 of the lever 30. As the cam boss 12 slides on the boss pick-up portion 35*b*, the lever 30 rotates in a direction of an arrow B (illustrated in FIG. 7). When the lever 30 rotates, the distal end 13*a* of the release rib portion 13 of the male housing 11 abuts against the temporary locking projection 36*a* of the temporary locking arm portion 36 of the lever 30.

Thereafter, as illustrated in FIG. 9, the cam boss 12 of the male housing 11 abuts against the boss receiving portion 35*c* of the cam groove 35 of the lever 30. As a result, even if the hood portion 11*a* of the male housing 11 is pushed further into the hood portion 22 of the female housing 20, the rotation of the lever 30 in the direction of the arrow B is prevented (force vector is prevented from tilting when hood portion 11*a* is pushed further into hood portion 22). Consequently, the position of the lever 30 when the male housing 11 and the female housing 20 are temporarily set is restricted. Since the boss receiving portion 35*c* that receives the cam boss 12 of the male housing 11 is formed in the cam groove 35 of the lever 30 as described above, it is possible to prevent the lever 30 from rotating in the direction of the arrow B when the male housing 11 and the female housing 20 are temporarily set. Further, before the operating portion 31 of the lever 30 is operated, it is possible to reliably prevent electrical conduction between terminals of the male housing 11 and the female housing 20 in a state where the male housing 11 and the female housing 20 are temporarily set.

In addition, as illustrated in FIG. 9, when the cam boss 12 of the male housing 11 abuts against the boss receiving portion 35*c* of the cam groove 35 of the lever 30, the distal end 13*a* of the release rib portion 13 of the male housing 11 abuts against the temporary locking arm portion 36 of the lever 30 and pushes the temporary locking arm portion 36 upward. As a result, the temporary locking state of the cutaway portion 25 of the female housing 20 and the temporary locking projection 36*a* of the temporary locking arm portion 36 of the lever 30 starts to be released. Since the cam boss 12 of the male housing 11 is received by the boss receiving portion 35*c* of the cam groove 35 of the lever 30 as described above, the same structure makes it possible to temporarily set the male housing 11 and the female housing 20, and release the temporary locking state of the temporary locking arm portion 36 of the lever 30.

Figure 11:
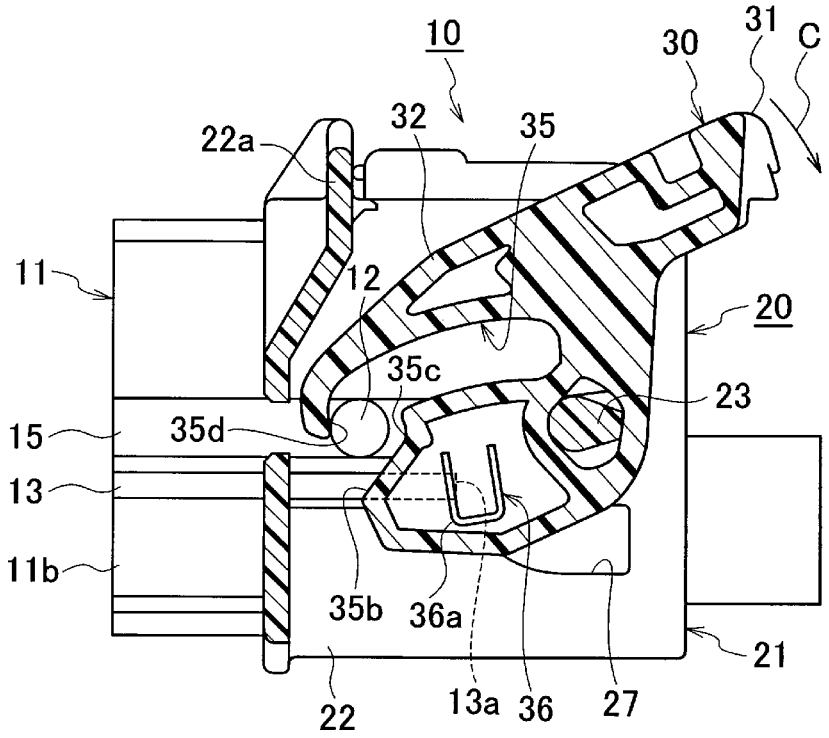
FIG. 11 is a sectional view taken along the line A-A in FIG. 6, illustrating the state where the temporary setting of the male housing and the female housing is maintained.

Furthermore, as illustrated in FIG. 11, when the lever 30 is rotated in a direction of an arrow C after the male housing 11 and the female housing 20 are temporarily set, the cam boss 12 of the male housing 11 is hooked on the boss holding portion 35*d* of the cam groove 35 of the lever 30. This prevents the male housing 11 from being removed from the female housing 20.

As illustrated in FIG. 7, by separately forming, in the cam groove 35 of the lever 30, the boss pick-up portion 35*b* into which the cam boss 12 of the male housing 11 is inserted and the boss holding portion 35*d* that holds the cam boss 12, the insertion force at the time of temporarily setting the male housing 11 and the female housing 20 can be reduced.

Further, as illustrated in FIG. 11, since the cam boss 12 of the male housing 11 is held by the boss holding portion 35*d* of the cam groove 35 of the lever 30 in a state where the male housing 11 and the female housing 20 are temporarily set, the male housing 11 cannot be removed from the female housing 20 unless the lever 30 is operated. With this structure, the force of maintaining the temporary setting of the male housing 11 and the female housing 20 can be improved.

Moreover, as illustrated in FIG. 9, since the boss receiving portion 35*c* is formed in the cam groove 35 of the lever 30, even if the hood portion 11*a* of the male housing 11 is pushed further into the hood portion 22 of the female housing 20, the rotation of the lever 30 in the direction of the arrow B can be prevented. That is, since the boss receiving portion 35*c* that receives the cam boss 12 of the male housing 11 is formed in the cam groove 35 of the lever 30, it is possible to prevent the lever 30 from rotating in the direction of the arrow B when the male housing 11 and the female housing 20 are temporarily set.

While the present embodiment has been described above, the present embodiment is not limited thereto, and various modifications can be made within the scope of the gist of the present embodiment.

That is, according to the embodiment described above, the cutaway portion of the female housing functioning as a temporarily locked portion and the temporary locking projection of the temporary locking arm portion of the lever functioning as a temporary locking portion are temporarily locked to each other, however, the temporarily locked portion may be a recess, a protrusion, or the like besides the cutaway portion.

Next, a comparative example will be described. A lever-type connector 1 according to the comparative example includes a housing 2 having a hood portion 4 that is fitted into and removed from a mating housing 8. In addition, the lever-type connector 1 includes a lever 5. By rotating the lever 5 from an initial orientation to a fitting completion position, a cam groove 6 is engaged with a cam pin 9 and thus the housings 2 and 8 are fitted to each other. In this lever 5, the mounting portions 5*a*, 5*a* are each rotatably supported by support shafts 3 on both sides of the housing 2. Further, the lever 5 has the cam groove 6 that engages with the cam pin 9 arranged in the mating housing 8. Moreover, each of the mounting portions 5*a*, 5*a* of the lever 5 includes a locking projection 7 for restricting the rotation of the lever 5 at a position shifted from an introduction trajectory of the cam pin 9 into the cam groove 6.

When the cam pin 9 are introduced in the cam groove 6 at the initial stage of fitting the housings 2 and 8, a pressed portion 8*a* formed on each of both sides of the mating housing 8 engages with the locking projection 7 of the lever 5. The locking projection 7 is displaced outward to be disengaged from an engagement groove 4*a* formed in the hood portion 4, so that the rotation restriction of the lever 5 is released. Unlike a case where the rotation restriction is released by the cam pin 9, the locking projection 7 is not displaced across the cam groove 6, and thus the amount of bending of the locking projection 7 is reduced as much as possible.

However, since the lever-type connector 1 according to the comparative example has a structure of reducing the amount of displacement of the lever 5 when its temporary set lock state is released, no holding force is applied between the housing 2 and the mating housing 8 in a temporary set state. Due to the lack of this holding force, the housing 2 may be easily removed from the housing 8 before the lever 5 is rotated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lever-type connector comprising:

a mating housing having a cam boss;

a housing that is fitted into and removed from the mating housing; and a lever that is rotatably supported by the housing via a support shaft, has a cam groove engaging with the cam boss, and is rotated from a temporary locking position to cause the cam groove to engage with the cam boss, thus moving the mating housing toward the housing and fitting the mating housing and the housing to each other, wherein the lever includes a temporary locking arm portion that has a temporary locking portion and is elastically deformable and configured to apply a force inward towards a center of the housing, the housing includes a temporarily locked portion that is temporarily locked to and unlocked from the temporary locking portion of the temporary locking arm portion, the mating housing includes a release rib portion that releases a temporary locking state of the temporary locking portion of the temporary locking arm portion and the temporarily locked portion of the housing, and the cam groove of the lever includes a boss pick-up portion and a boss holding portion that engage with the cam boss, wherein, at an opening of the cam groove, a tip end of the boss holding portion faces a step of the boss pick-up portion in the cam groove and between a part of the boss pick-up portion extended from the opening to the step and an inner portion of the boss pick-up portion extended from the step and away from the opening, and the boss holding portion is configured to hold the cam boss in a state where the mating housing and the housing are temporarily set, and wherein the cam groove of the lever includes a boss receiving portion that receives the cam boss when the temporary locking state of the temporary locking portion of the temporary locking arm portion and the temporarily locked portion of the housing is released in a state where the mating housing and the housing are temporarily set.

2. The lever type connector according to claim 1, wherein the temporary locking arm portion is further configured to apply a force inward towards the center of the housing along a track of the mating housing.

3. A lever-type connector comprising:

a mating housing having a cam boss;

a housing that is fitted into and removed from the mating housing; and a lever that is rotatably supported by the housing via a support shaft, has a cam groove engaging with the cam boss, and is rotated from a temporary locking position to cause the cam groove to engage with the cam boss, thus moving the mating housing toward the housing and fitting the mating housing and the housing to each other, wherein the lever includes a temporary locking arm portion that has a temporary locking portion and is elastically deformable and configured to apply a force inward towards a center of the housing, the housing includes a temporarily locked portion that is temporarily locked to and unlocked from the temporary locking portion of the temporary locking arm portion, the mating housing includes a release rib portion that releases a temporary locking state of the temporary locking portion of the temporary locking arm portion and the temporarily locked portion of the housing, and the cam groove of the lever includes a boss pick-up portion and a boss holding portion that engage with the cam boss, wherein the boss holding portion faces the boss pick-up portion in the cam groove, and the boss holding portion is configured to hold the cam boss in a state where the mating housing and the housing are temporarily set, wherein the cam groove of the lever includes a boss receiving portion that receives the cam boss when the temporary locking state of the temporary locking portion of the temporary locking arm portion and the temporarily locked portion of the housing is released in a state where the mating housing and the housing are temporarily set, and wherein the temporary locking arm portion is further configured to apply a force inward towards the center of the housing along a track of the mating housing.

* * * * *